US005584330A

United States Patent [19]

Muller

[11] Patent Number: 5,584,330

[45] Date of Patent: Dec. 17, 1996

[54] FLEXIBLE PARTITION

[76] Inventor: Peter J. Muller, 960 E. Cottonwood Ave., Littleton, Colo. 80121

[21] Appl. No.: 550,534

[22] Filed: Oct. 30, 1995

[51] Int. Cl.[6] ..... A47G 5/00

[52] U.S. Cl. ..... 160/135; 160/352; 52/169.4; 256/24; 256/26

[58] Field of Search ..... 160/135, 351, 160/352; 52/169.1, 169.3, 169.4; 256/24, 26, 25

[56] References Cited

U.S. PATENT DOCUMENTS

| | | | |
|---|---|---|---|
| 1,363,187 | 12/1920 | Miller et al. . | |
| 2,682,235 | 6/1954 | Fuller | 108/1 |
| 2,806,526 | 9/1957 | Marcus | 160/135 |
| 4,063,585 | 12/1977 | Stanley | 160/135 |
| 4,219,958 | 9/1980 | Shulyak | 46/1 R |

*Primary Examiner*—David M. Purol

[57] ABSTRACT

Partitions formed of edgewise connected panels have not historically had the capability of following vertical curves as required by naturally rolling terrain. My self-supporting edgewise connected partition formed of substantially triangular shaped panels (10, 12, 14, 16, 18, 20, 22 and 24) has the capability to simultaneously follow a straight or curved vertical alignment and a straight or curved horizontal alignment in any combination. Both the flexibility of the partition and its ability to support itself result from it being formed of a plurality of two differently shaped panels (10 and 12). The panels are shaped in such a way that, when their abutting edges are joined, the lower edges cross back and forth across the alignment (be it straight or curved) defined by upper edges. The amount that the two sets of panels differ in shape determines the furthest amount that the lower edges deviate from the alignment of the upper edges thus affecting the stability of the partition and its flexibility to follow vertical curves.

11 Claims, 4 Drawing Sheets

FLEXIBLE PARTITION

BACKGROUND—FIELD OF INVENTION

This invention relates to a partition for dividing space.

DEFINITIONS OF TERMS

The basic and fundamental nature of the invention discussed herein makes it desirable to carefully define certain terms, some of which are used with a special connotation, as follows:

Apex: The point of a triangle opposite the base

Base: That side of a triangle which is substantially horizontal

Lower Panel: A triangular-shaped panel with its base lowest and its apex uppermost or a polygon-shaped panel with its lower edge longer than its upper edge Upper Panel: A triangular-shaped panel with its base uppermost and its apex lowest or a polygon-shaped panel with its upper edge longer than its lower edge

BACKGROUND—DISCUSSION OF PRIOR ART

Partitions for dividing space are either supported by foundations (e.g., walls and fences) or self-supporting. When the latter types utilize edgewise connected panels, they have commonly achieved their self-supporting characteristics by deviating from a linear alignment and typically must be supported by a planar (usually horizontal) base such as a floor or foundation pad. The geodesic dome in U.S. Pat. No. 2,682,235 to Fuller, 1954 Jun. 29 is self-supporting by means of its curvature. The portable screen in U.S. Pat. No. 1,363,187 to Miller, 1920 Dec. 21 is self supporting only if one or more of its elements deviate from a straight line. However, the folding screen for hospital bed in U.S. Pat. No. 2,806,526 to Marcus, 1957 Sep. 17 is self-supporting even if the elements are laid out in a straight line. None of the prior art has the capability of self-support while following a linear horizontal alignment and a simultaneous curved vertical alignment (although the portable screen in U.S. Pat. No. 1,363,187 to Miller 1920, Dec. 21 can accommodate limited vertical irregularities). Thus, the prior art teaches that partitions that are required to simultaneously follow linear horizontal alignments and curved vertical alignments (such as exterior fences or walls) are supported by foundations and are not constructed of edgewise connected panels.

OBJECTS AND ADVANTAGES

Accordingly, several objects and advantages of my invention are that, while it is constructed of edgewise connected panels, it is self-supporting and can follow vertical curves (both crest and sag) while its uppermost surface is deployed along a straight horizontal alignment. In addition, my invention can be aligned along any combination of straight or curved vertical and horizontal alignments. Horizontal curvature as severe as a right-angled turn can be accommodated. The degree of vertical curvature that can be accommodated is a function of the relative dimensions of the panels.

It is a further object of my invention that the panels can be disconnected, stacked upon one another and thus readily transported and reassembled at another location. Alternatively, the panels may be of heavy construction, weighted down or anchored to the ground to provide a permanent installation which by virtue of its geometry is more capable of withstanding the elements than a typical wooden fence.

Another object of my invention is to provide a partition which is eminently suitable for construction of plastic or similar material and which takes full advantage of the characteristics of plastic and similar materials.

Yet a further object of my invention is to provide a partition which, when constructed of relatively heavy material (such as concrete), is able to be self-supporting and capable of resisting lateral loads such as those due to wind without the need for foundations or anchors.

LIST OF REFERENCE NUMERALS

10,14,18,22 upper triangular panel

12,16,20,24,34,36 lower triangular panel

Figure 1:
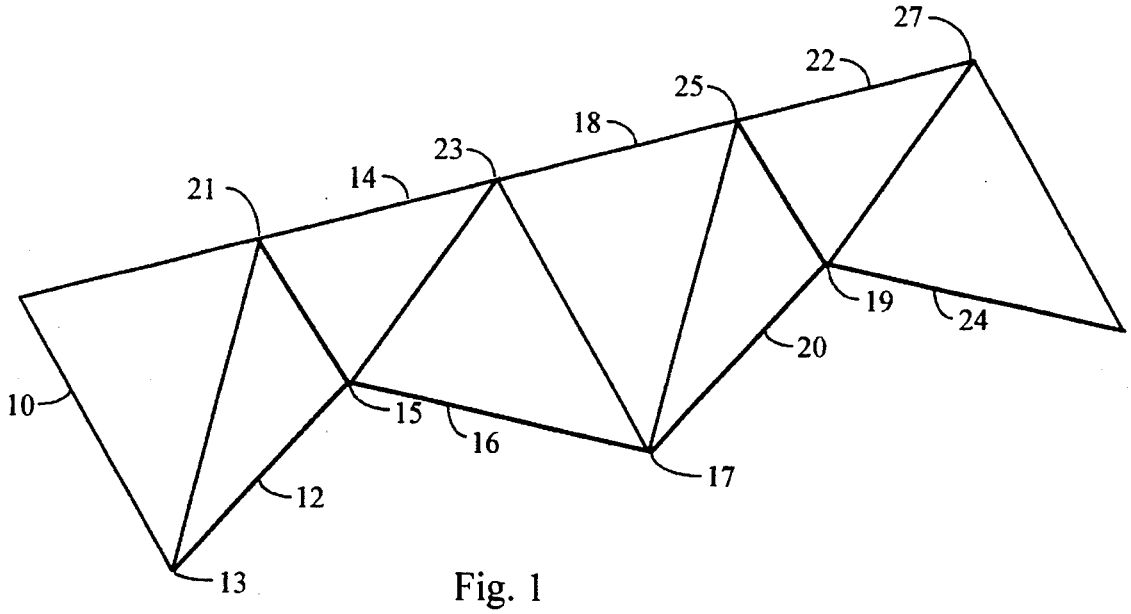
FIG. 1 is a perspective view of my partition.

13,15,17,19,21,23,25,27 apexes of panels 10, 14, 18, 22, 12, 16, 20 and 24 respectively

17*a*, 17*b*, 17*c*, 17*d*, 19*a*, 19*b*, 19*c*, 19*d*, 25*a*, 25*b*, 27*a*, 27*b* adjusted positions of apexes of panels 17, 19, 25, and 27 respectively

18*d*, 20*d*, 22*d*, 24*d* adjusted positions of panels 18, 20, 22 and 24 respectively

30, 32 upper polygon-shaped panel

38, 40 sides of polygon-shaped panel

42 ground surface

DESCRIPTION OF INVENTION

FIG. 1 shows a perspective view of a basic version of my partition. Pluralities of similar triangular-shaped upper panels (10, 14, 18, and 22) are arranged with their apexes down and with their bases end to end to form a straight line. Their apexes (13, 15, 17, and 19) are arranged to alternate on either side of the common centerline formed by their bases. Pluralities of other, similar triangular-shaped lower panels (12, 16, 20, and 24) are arranged with their apexes (21, 23, 25 and 27) up to fit between the upper panels. The upper and lower panels are connected along their adjoining edges to form a partition.

While all of the upper (apex-down) panels have identical dimensions, and all lower (apex-up) panels have identical dimensions, the panels of each group have different dimensions. The bases of the lower panels are longer than the bases of the upper panels.

For apexes 21, 23, 25 and 27 to lie directly along the partition's common, straight centerline, apexes 13, 15, 17, and 19 must be spaced at equal distances on either side of the centerline if the partition is placed on a fiat surface. The amount of this offset distance is relative to the difference in length of the bases of the lower panels to the bases of the upper panels.

The means for connecting the adjoining edges of the upper and lower panels together can be hinged to allow full flexibility of the partition. Alternatively they can be rigidly fastened together once the partition has been adjusted to the required line and grade.

Figure 2:
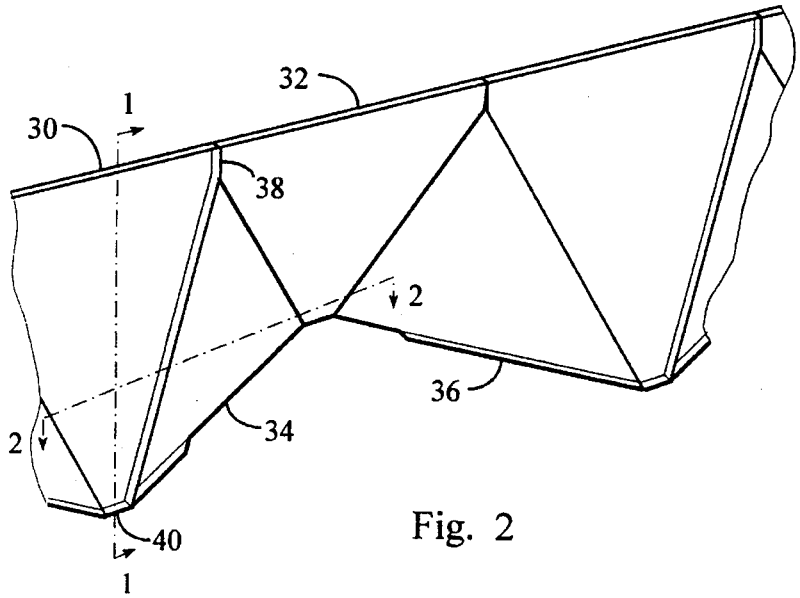
FIG. 2 is a perspective view demonstrating the preferred embodiment of my partition.

FIG. 2 shows a perspective view of the preferred embodiment of my partition. In this embodiment the upper and lower panels are solid and are manufactured of plastic. Pluralities of upper panels (30 and 32) are arranged as before and alternate with a plurality of lower panels (34 and 36). The upper panels (30 and 32), while having an overall triangular shape, are in fact polygons with vertical sides (38) and horizontal lower edges (40). The vertical sides (38) allow connecting the upper panels (30 and 32) to each other as well as to the lower panels (34 and 36). The horizontal lower edges (40) facilitate weighing or anchoring the partition down to enhance its ability to withstand lateral loads such as those due to wind. The lower panels are triangular in shape. The edges of the upper and lower panels are folded at approximately 90 degrees to provide strengthening and to facilitate interconnecting.

Figure 3:
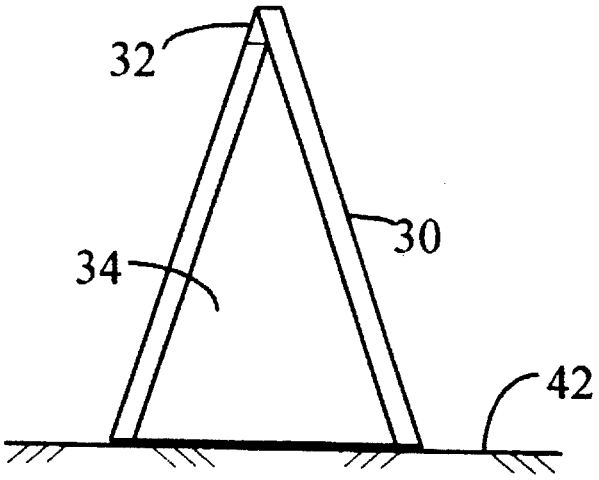
FIG. 3 is a view of the portion indicated by section line 1—1 in FIG. 2.

FIG. 3 is a view of the portion indicated by the section line 1—1 in FIG. 2. This view shows the triangular cross-sectional shape of the partition. It also shows the ground surface (42).

Figure 4:
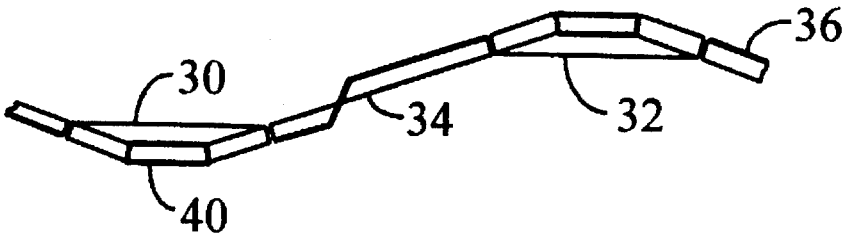
FIG. 4 is a view of the portion indicated by section line 2—2 in FIG. 2.

FIG. 4 is a view of the portion indicated by the section line 2—2 in FIG. 2.

The upper and lower panels of the partition may incorporate ridges and/or indentations to enhance their structural integrity. Such ridges and indentations may be arranged to form patterns, pictures or representations pleasing to the eye and thus enhancing the appearance of the partition.

OPERATION OF INVENTION

I have discovered that numerous unexpected advantages accrue as a result of the lower panels having longer bases than the upper panels. The longer bases permit the lower panels to cross back and forth over the common centerline of the partition whereby it is provided with the lateral support necessary to make it self-supporting. In addition the partition gains flexibility not evidenced in the prior art which allows it to follow the natural contour of the ground while the uppermost surface of the partition follows either a straight or a curved line. An added benefit is that the angle formed at the adjoining edges of the panels adds to the structural integrity of the system.

Figure 5:
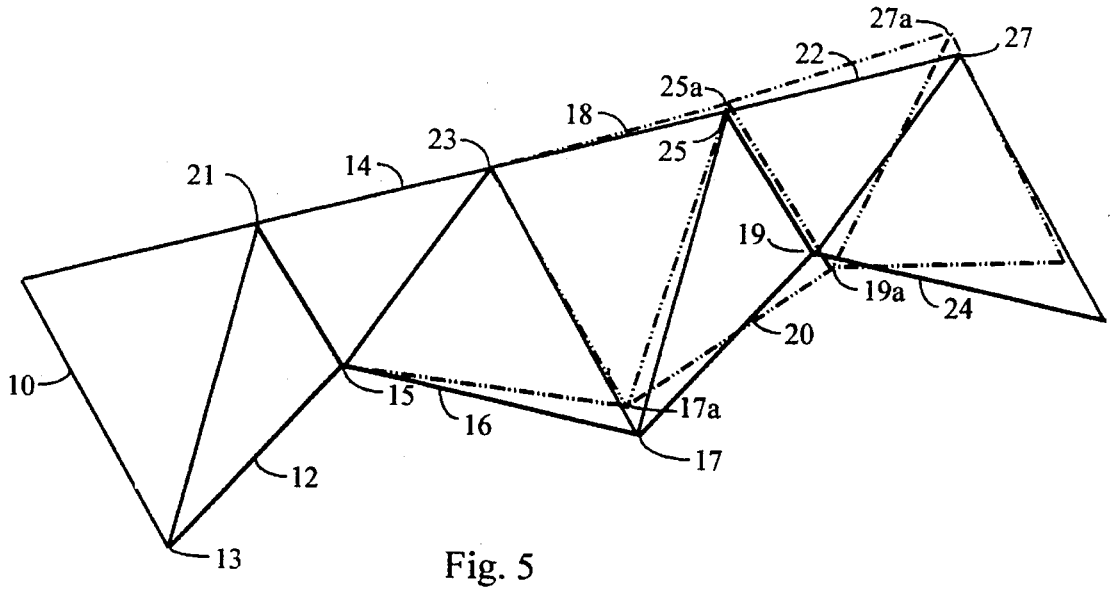
FIG. 5 is a perspective view of my partition demonstrating its ability to accommodate a sag vertical curve.

FIG. 5 is a perspective view of a basic version of my partition demonstrating its ability to follow a sag vertical curve while the upper surface of the partition is maintained in a straight line (horizontally). As before, the partition's common centerline is initially straight both vertically and horizontally. After adjustment, the partition's common centerline is straight horizontally but curves upwards vertically after passing apex 23. To bring about this upward curvature apex 17 is moved to a new position (17*a*) closer to the common centerline and apex 19 is moved to a new position (19*a*) also closer to the common centerline. These adjustments result in negligible movement of apex 23 and in apex 25 remaining on centerline horizontally but being raised up to a new position (25*a*) causing the upward vertical curvature of the adjusted common centerline. Continued inward adjustment of the downward apexes results in continued upward curvature of the partition.

Figure 6:
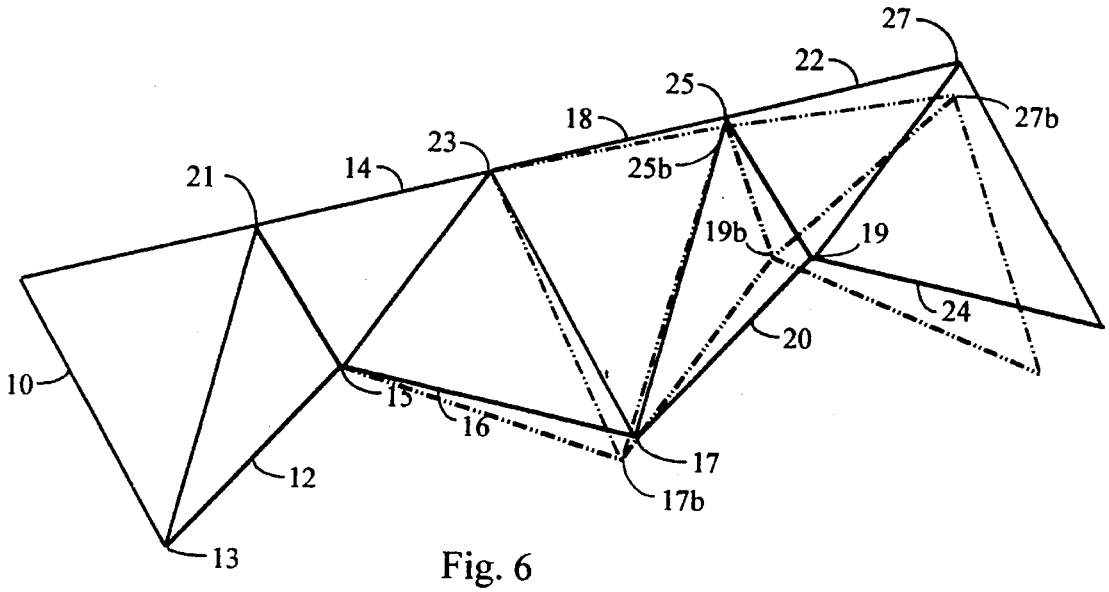
FIG. 6 is a perspective view of my partition demonstrating its ability to accommodate a crest vertical curve.

FIG. 6 is a perspective view of a basic version of my partition demonstrating its ability to follow a crest vertical curve while the upper surface is maintained in a straight line (horizontally). As before, the partition's common centerline is initially straight both vertically and horizontally but, after adjustment, curves downwards after passing apex 23. To bring about this downward curvature apex 17 is moved to a new position (17*b*) further from the common centerline and apex 19 is moved to a new position (19*b*) also further from the common centerline. These adjustments result in negligible movement of apex 23 and in apex 25 remaining on the common centerline horizontally but being lowered to a new position (25*b*) causing the downward vertical curvature of the adjusted common centerline. Continued outward adjustment of the downward apexes results in continued downward curvature of the partition.

Figure 7:
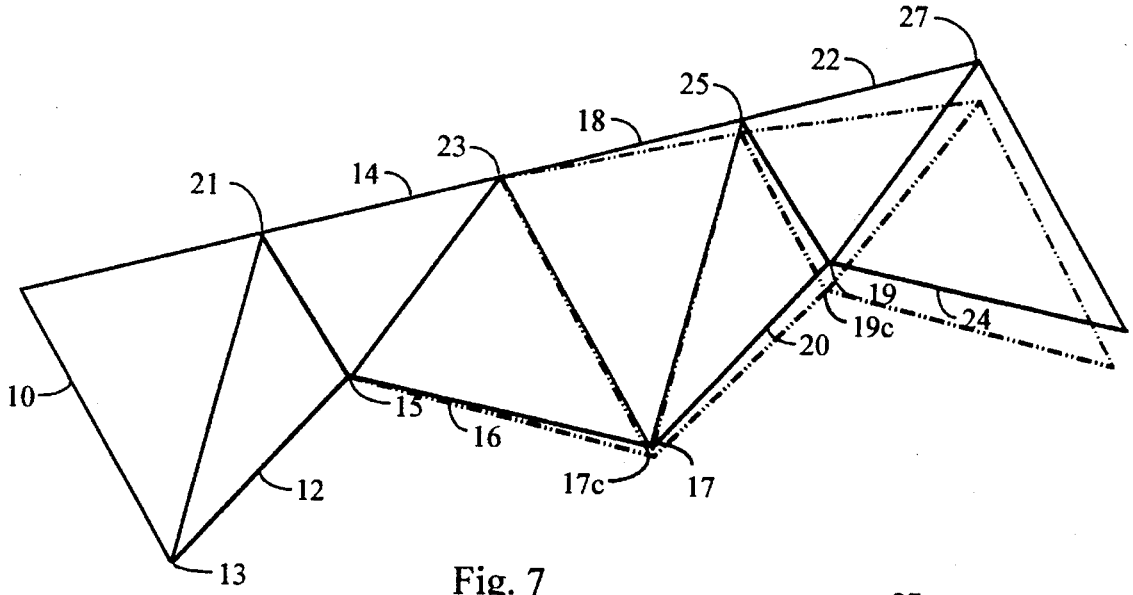
FIG. 7 is a perspective view of my partition demonstrating its ability to accommodate a horizontal curve.

FIG. 7 is a perspective view of a basic version of my partition demonstrating its ability to follow a horizontal curve while maintaining a straight vertical profile. This is accomplished by repositioning the apexes progressively more and more to the side toward which it is desired to curve the partition. Thus apexes 13 and 15 remain in their previous positions, apex 17 is moved to a new position (17*c*), 19 to 19*c*, etc. As before, adjusting the apexes in or out relative to the common centerline results in the partition curving upwards or downwards.

Figure 8:
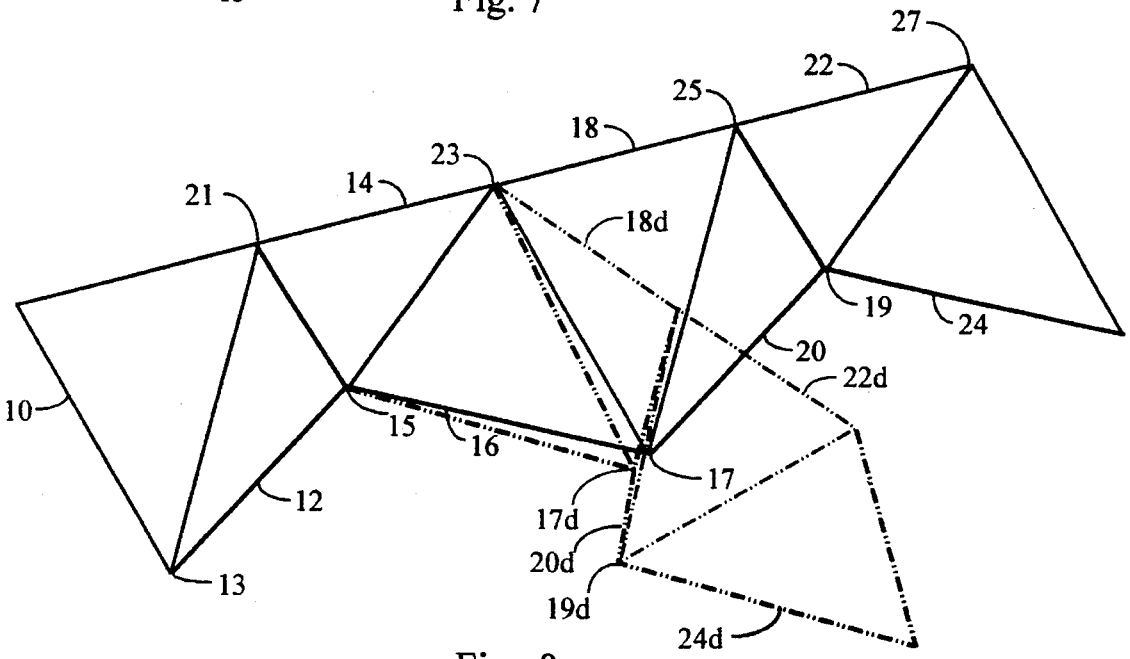
FIG. 8 is a perspective view of my partition demonstrating its ability to accommodate a ninety-degree change in direction.

FIG. 8 is a perspective view of a basic version of my partition demonstrating its ability to accommodate a ninety-degree change in direction. This is accomplished by pivoting panels 18, 20, 22 and 24 about apex 23 to new positions 18*d*, 20*d*, 22*d*, and 24*d* and by relocating apexes 17, 19, etc. to the other side of the common centerline to new positions 17*d*, 19*d*, etc.

With reference to FIGS. 5 through 8, I have discovered that it is only necessary to pay attention to aligning the upper apexes (21,23,25, and 27) along the desired horizontal alignment while adjusting the position of the lower apexes (13, 15, 17, and 19). When the upper apexes are aligned along the desired horizontal alignment and the lower apexes are firmly in contact with the ground, the partition naturally and automatically follows the contour of the ground.

CONCLUSION, RAMIFICATIONS AND SCOPE OF INVENTION

Thus, the reader will see that the partition of the invention provides a stable, lightweight and easily assembled partition capable of following rolling terrain and incorporating lateral stability.

While my above description contains many specificities, these should not be construed as limitations on the scope of the invention, but rather as an exemplification of one preferred embodiment thereof. Many other variations are possible. For example the triangular elements may be open and formed of rod-like material. Open triangular elements which abutt each other may be joined at the corners and may share the component which forms their adjoining edge. Fabric or wooden slats may be attached to such an open-framed partition if a visual barrier is required or to act as a silt fence, for example.

Alternatively the panels may be formed of heavy material such as concrete thus providing a permanent partition capable of withstanding lateral loading from wind or retained earth without the need for a foundation or anchors. In addition, all of the panels may be modified to polygonal shapes in place of true triangular shapes. Accordingly, the scope of the invention should be determined not by the embodiments illustrated, but by the appended claims and their legal equivalents.

I claim:

1. In a flexible partition supported on a ground surface, said flexible partition comprising:

a plurality of upper and lower substantially triangularly shaped panels each having a base with a side edge disposed along each end thereof of said base terminating at an apex, said plurality of upper panels disposed with the bases above and parallel to said surface and with the apexes supported by said surface, said plurality of lower panels disposed with the apexes above said surface and with the bases parallel to and supported on said surface, joining means for interconnecting said side edges of said upper panels to said side edges of said lower panels such that each apex of said lower panels abuts an end of the base of said upper panels, each of said bases of said Upper panels having a first length and each of said bases of said lower panels having a second length, wherein, said first length is less than said second length, whereby said partition is self-supporting and adapted to accommodate ground surfaces of irregular alignments.

2. The flexible partition of claim 1 wherein said panels are made of plastic.

3. The flexible partition of claim 1 wherein said panels are made of concrete.

4. The flexible partition of claim 1 wherein said panels are made of wood.

5. The flexible partition of claim 1 wherein said panels are made of metal.

6. The flexible partition of claim 1 wherein said panels are substantially solid.

7. The flexible partition of claim 1 wherein said panels are substantially open.

8. The flexible partition of claim 7 wherein said panels are formed of rod-like material.

9. The flexible partition of claim 7 wherein said panels share a common component forming thereof adjoining edges.

10. The flexible partition of claim 7 wherein cloth, wooden slats or similar material is attached to said open panels.

11. The flexible partition of claim 1 wherein said joining means comprises a hinge.

* * * * *